United States Patent [19]

Breslow et al.

[11] 4,326,710

[45] Apr. 27, 1982

[54] TALKING ELECTRONIC GAME

[75] Inventors: Jeffrey D. Breslow, Highland Park; Erick E. Erickson, Chicago, both of Ill.

[73] Assignee: Marvin Glass & Associates, Chicago, Ill.

[21] Appl. No.: 119,618

[22] Filed: Feb. 8, 1980

[51] Int. Cl.[3] ..... A63F 9/00; G09B 7/02

[52] U.S. Cl. ..... 273/1 E; 179/1 SM; 434/321

[58] Field of Search ..... 273/1 E, 85 G; 179/1 SA, 1 SQ, 1 SM; 434/308, 319, 321, 335, 339

[56] References Cited

U.S. PATENT DOCUMENTS

| | | | |
|---|---|---|---|
| 3,136,072 | 6/1964 | Ross | 434/319 |
| 3,696,525 | 10/1972 | Cleary | 434/339 |
| 3,908,288 | 9/1975 | Brown, Jr. | 434/319 |
| 3,928,722 | 12/1975 | Nakata et al. | 179/1 SM |
| 4,179,584 | 12/1979 | Tanimoto et al. | 179/1 SM |
| 4,189,779 | 2/1980 | Brautingham | 179/1 SM X |
| 4,296,279 | 10/1981 | Stork | 179/1 SM |

FOREIGN PATENT DOCUMENTS 1428157 3/1976 United Kingdom ..... 273/1 E

OTHER PUBLICATIONS

*Playmeter,* Technical Topics: "Games That Talk", Nov. 1978, p. 91.

*JSRA Catalog,* "Talking Computer", page 41.

*Primary Examiner*—William H. Grieb

*Attorney, Agent, or Firm*—Mason, Kolehmainen, Rathburn & Wyss

[57] ABSTRACT

A talking electronic game utilizes an integrated circuit voice synthesizer to generate a plurality of beginning phrases each forming the beginning of a complete phrase and a plurality of ending phrases each forming the end of the complete phrase. The beginning and ending phrases are assigned at random to a plurality of push buttons, and the object of the game is to match up the beginning and ending phrases of the various sentences by appropriate actuation of the various push buttons.

29 Claims, 8 Drawing Figures

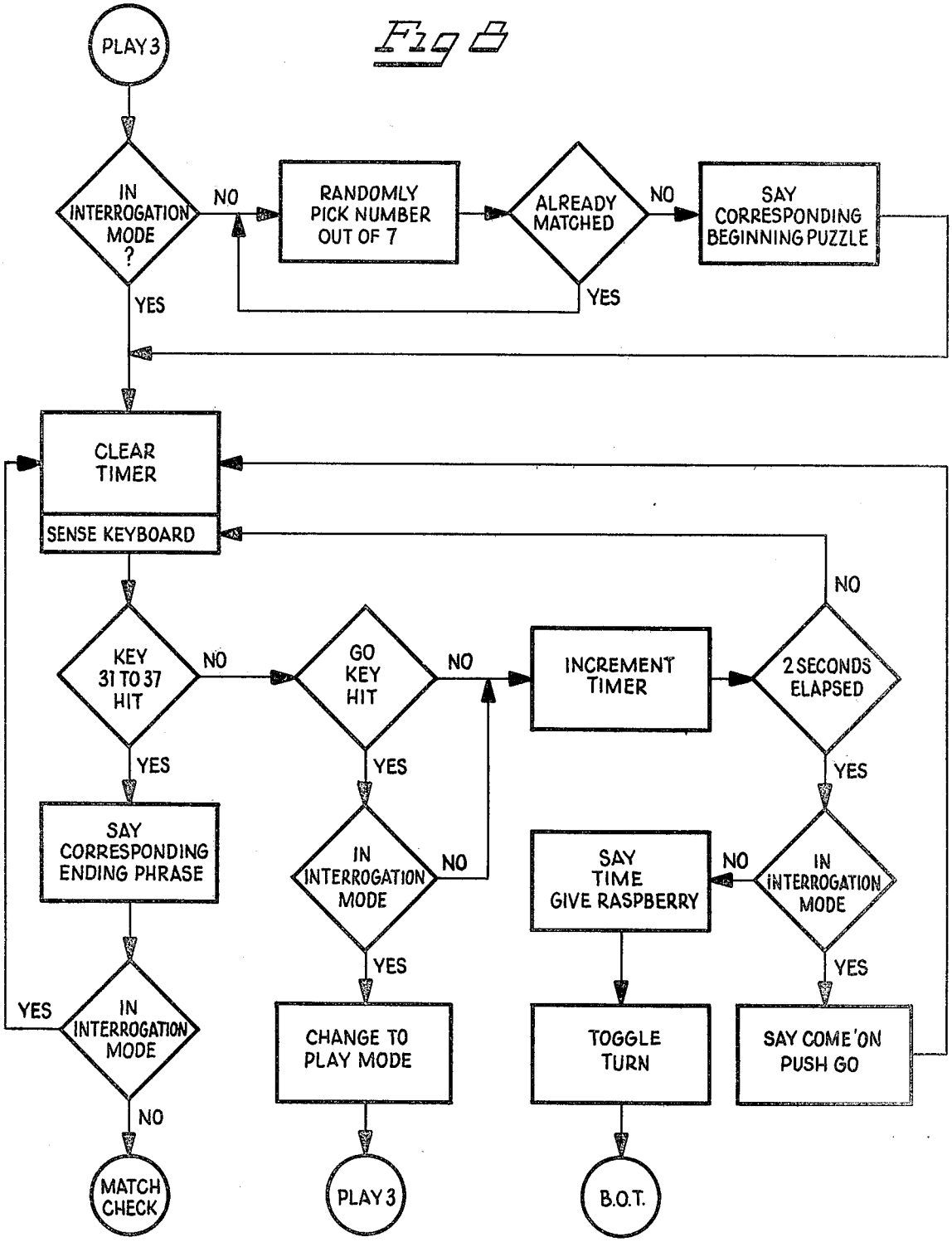
Fig 8
PLAY 3
IN INTERROGATION MODE ?
NO
YES
RANDOMLY PICK NUMBER OUT OF 7
ALREADY MATCHED
NO
YES
SAY CORRESPONDING BEGINNING PUZZLE
CLEAR TIMER
SENSE KEYBOARD
KEY 31 TO 37 HIT
NO
YES
GO KEY HIT
NO
YES
INCREMENT TIMER
2 SECONDS ELAPSED
NO
YES
SAY CORRESPONDING ENDING PHRASE
IN INTERROGATION MODE
NO
YES
SAY TIME GIVE RASPBERRY
NO
IN INTERROGATION MODE
YES
YES
IN INTERROGATION MODE
YES
NO
CHANGE TO PLAY MODE
TOGGLE TURN
SAY COME 'ON PUSH GO
MATCH CHECK
PLAY 3
B.O.T.

TALKING ELECTRONIC GAME

BACKGROUND OF THE INVENTION

1. Field of the Invention

This invention relates generally to electronic games, and more particularly, to talking electronic games wherein the game generates a voice stimulus and a voice response in response to the actuation of a push button, keyswitch or the like.

2. Description of the Prior Art

Electronic talking games are known as are electronic talking teaching devices that teach spelling, foreign languages or the like. One example of an electronic talking game is "SPEAK & SPELL" manufactured by Texas Instruments which provides an audible stimulus such as the pronunciation of a word and requires the participant to spell the word pronounced. In another mode of operation, the aforesaid "SPEAK & SPELL" game requires the word pronounced by the machine to be repeated by the participant, or requires the participant to enter an unknown, randomly generated word into the machine via a keyboard. If the word is entered with less than a predetermined number of errors, the machine states audibly "you win", while if the number of errors exceeds the predetermined number, the machine states "I win". While the above "SPEAK & SPELL" machine interacts with a participant by providing a voice stimulus, it is primarily a teaching machine and has no provision for permitting two players to play against each other, nor any provision for embarrassing a player that makes an error.

SUMMARY OF THE INVENTION

Accordingly, it is an object of the present invention to provide an electronic game that generates a voice stimulus to which the player must respond, and which provides another voice stimulus that embarrasses the player in the event of an incorrect response.

It is another object of the present invention to provide an electronic game device that provides a voice stimulus that anunciates the first part of a complete phrase, sentence or common saying to a player to which the player must respond by pressing an appropriate push button or keyswitch to select a voice response enunciating the completion of the complete phrase, sentence or saying.

It is yet another object of the invention to provide an electronic voice generating gaming device wherein the beginning phrases and ending phrases forming the complete phrase, sentence or saying are chosen so that the resultant combination of an incorrectly matched beginning and ending phrase is a ridiculous statement that embarrasses the player when he makes a mistake.

It is still another object of the present invention to provide a voice generating electronic game wherein two players may play against each other in competition to determine which player matches the most beginning and ending phrases.

In accordance with a preferred embodiment of the invention, there is provided a housing containing a microcomputer, a read-only memory, and a voice synthesizer integrated circuit chip. The read-only memory contains data which permit the voice synthesizer chip to generate electrical signals representative of voice statements when the data are addressed in a particular sequence under the control of the microcomputer. A loudspeaker, mounted within the housing and electrically coupled to the voice synthesizer chip, serves to generate acoustic waves in response to the electrical voice signals synthesized by the synthesizer chip. Two groups of push buttons, each associated at random with a particular phrase generated by the voice synthesizer are provided, as well as one or more selector switches for selecting various games to be played. In addition, a light that operates in synchronism with the syllabic rate of the synthesized voice is provided as are switches that initiate game play, provide an indication of the score, or reset the game.

DESCRIPTION OF THE DRAWING

The above and other advantages of the present invention will become readily apparent upon consideration of the following detailed description and attached drawing, wherein:

FIGS. 3 through 8 are logical flow charts illustrating the operation of the game according to the invention.

DETAILED DESCRIPTION OF THE PREFERRED EMBODIMENT

Figure 1:
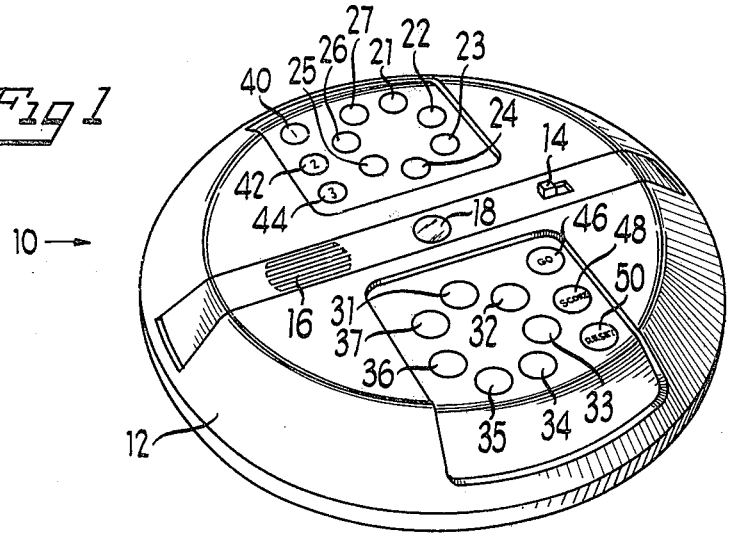
FIG. 1 is a perspective view of the exterior of the electronic game according to the invention.
Figure 7:
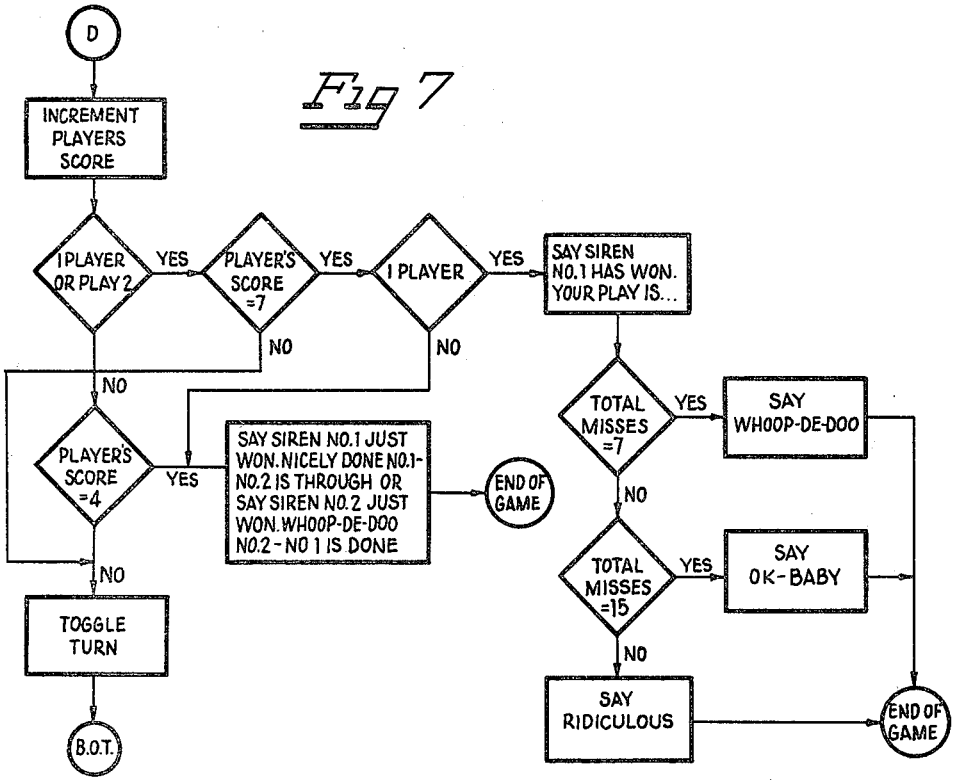

Referring now to the drawing, with particular attention of FIG. 1, there is shown a preferred embodiment of the game according to the invention, generally designated by the reference numeral 10. The game includes a housing 12 on which is mounted an off/on-land /on-soft switch 14, a loudspeaker (not shown in FIG. 1) mounted beneath a grille 16 and a lens 18 disposed over a light source (not shown) mounted within the housing 12. In addition, two sets of playing push buttons 21–27 and 31–37 are disposed on the housing 12 and are manually operable by one or more players to permit the game to be played. The push buttons 21–27 and 31–37 may be different colors, for example, 21–27 may be red and 31–37 may be yellow, to identify them as beginning and ending phrase push buttons. Three game selector push button switches 40, 42 and 44, which may be labelled 1, 2 and 3, permit one of three different games to be selected. A go switch 46 serves to initiate play for Game 3, a score switch 48 is depressed to indicate the player's scores, and a reset switch 50 is used to reset the device to permit a new game to be played.

In operation, when the device is turned on via the power on/off switch 14, the device makes some introductory remarks and then queries the player as to which game he wishes to play by means of an oral statement from the loudspeaker beneath the grille 16 such as "Hey, hey, hey, pick your play". The player then responds by pressing one of the game selector push buttons 40, 42 and 44 to pick Game 1, 2 or 3. The device responds by indicating the game choice audibly by means of a statement such as "Play 1". The device then issues an audible statement requesting the player to indicate how many players are going to participate in the game by means of an audible statement such as "How many wanna play?" to which the player responds by pressing one of the push buttons 40 or 42 to indicate whether one or two players are going to play. The device confirms this choice by means of an audible statement such as "Two (or one) to play, hey, hey, hey".

After the game to be played has been chosen and a number of players indicated, the device assigns at random seven beginning phrases to the seven push-button keyswitches 21–27 of the first group of keyswitches, and assigns at random seven ending phrases to the other seven push-button keyswitches 31–37. The device then audibly announces the seven game sentences or sayings, and the game begins, with the player or players trying to match the beginning and ending phrases by means of appropriate actuation of the push buttons 21–27 and 31–37.

Several modes of play are possible, with the following games being representative of the types of games that can be selected by the three game selector push buttons 40, 42 and 44. The following playing sequences are possible:

GAME 1 - One Player Version

1. The device randomly assigns the seven beginning and seven ending phrases to the fourteen playing keys 21–27 and 31–37, respectively.
2. The player depresses one of the push buttons 21–27 to select a beginning phrase.
3. The player then depresses one of the push buttons 31–37 in an attempt to select an ending phrase that matches the previously selected beginning phrase.
4. The player continues to depress one of the keys 21–27 and a corresponding one of the keys 31–37 until the seven beginning phrases are matched with the seven ending phrases.
5. The device keeps score by counting the number of correct matches. The device also counts the number of incorrect matches or misses. The object of the game is to match all seven complete phrases with the fewest number of errors. The number of correct matches at any point in the play may be determined by depressing the score push button 48.
6. The reset button 50 may be depressed by any time the keyboard is being read to start the game over again.

GAME 1 - Two Player Version

The two player version is similar to the one player version except that two players alternate turns in depressing one of the push buttons 21–27 and one of the push buttons 31–37 in an attempt to match the beginning and ending phrases. The first player to match four of the seven pairs of beginning and ending phrases is the winner.

GAME 2 - One Player Version

The one player version of Game 2 is identical to the one player version of Game 1 with the object being to match all seven pairs of beginning and ending phrases during one turn in the fewest number of attempts.

GAME 2 - Two Player Version

In the two player version of Game 2, the object is to be the first player to match all seven pairs of beginning and ending phrases during a single turn. An incorrect match is an end of turn for the player making the error, and brings up the other player.

GAME 3 - One Player Version

The device selects seven complete phrases which are spoken by the device and assigned sequentially to keys 21–27. After the phrases are spoken, all of the push buttons 31–37 corresponding to the ending phrases may be depressed by the player and the correspondence between the ending phrases and the pushbuttons memorized. When the go button 46 is depressed, the device randomly says one of the seven selected beginning phrases, and the player must depress the one of the pushbuttons 31–37 corresponding to the matching ending phrase as each beginning phrase is enunciated. The object of the game is to match all seven phrase pairs in the fewest number of tries.

GAME 3 - Two Player Version

The two player version is similar to the one player version except that two players alternate turns in depressing one of the pushbuttons 31–37 in an attempt to match the beginning phrase spoken by the device. The object of the game is to be the first player to get four of the seven phrase pairs matched.

Figure 2:
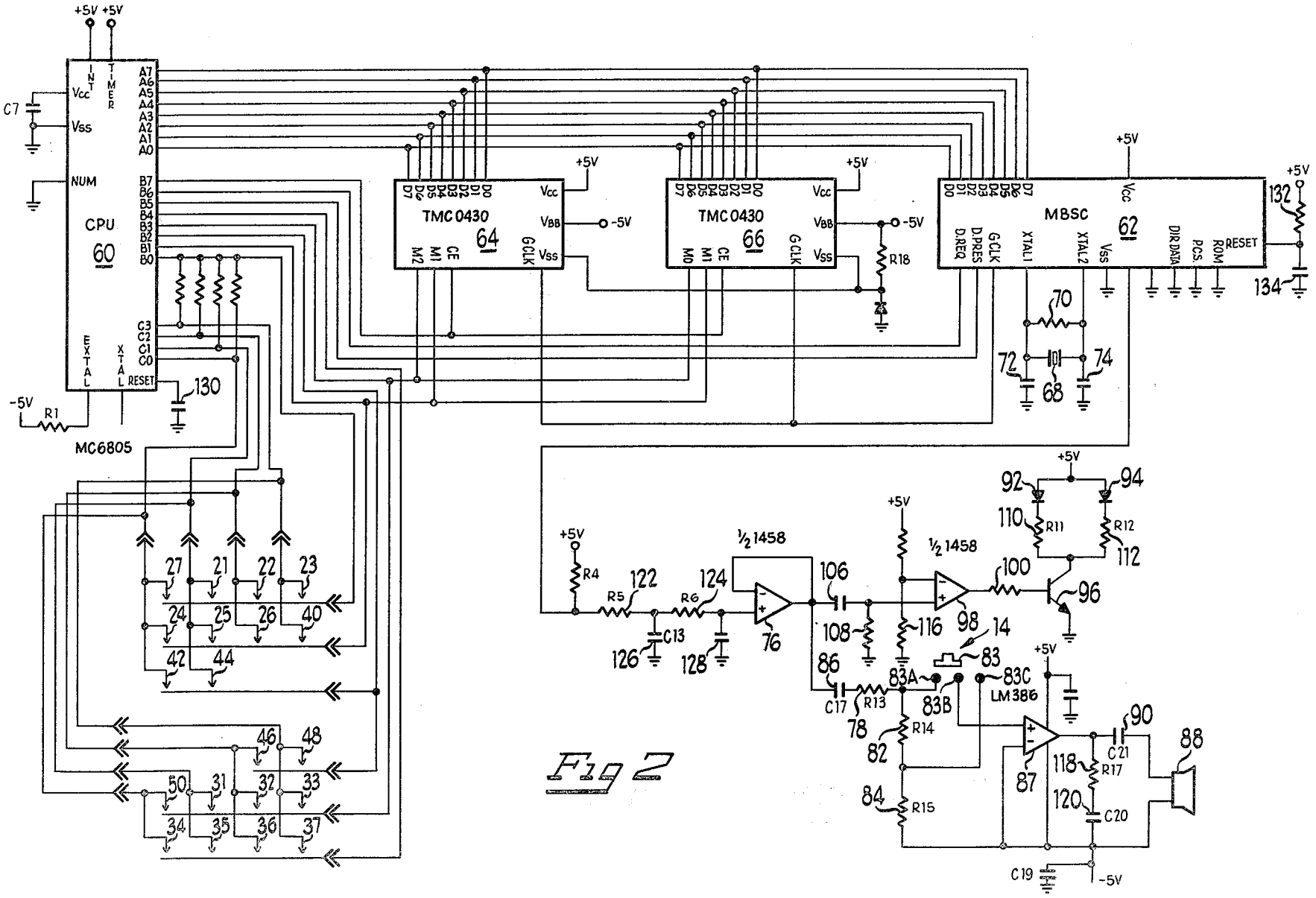
FIG. 2 is a schematic diagram of the electronic circuitry of the game according to the invention.

The device 10 utilizes integrated digital circuitry to provide the game playing logic and to generate the voice commands. In the present embodiment, the device 10 includes a central processing unit or microprocessor 60 (FIG. 2), such as, for example, an MC6805 microcomputer manufactured by Motorola, Inc. to control the various logical operations of the device 10. A speech integrated circuit 62 is provided, such as, for example, an integrated circuit manufactured by General Instruments Corp., 600 West John Street, Hicksville, N.Y. and disclosed in the copending U.S. Pat. No. 4,296,279. The speech synthesizer 62 is used to synthesize the voice signals produced by the device 10. The game playing rules (outlined in flow chart form in FIGS. 3–8) are stored in the memory portion of the microprocessor 60. The location and speech or sound generating data are stored in the two read-only memories 64 and 66 (FIG. 2). In the preferred embodiment, these ROMs are TMC0430 I.C. manufactured by Texas Instruments Corp. All of the information or data required by the speech chip 62 to generate the voice signals is permanently stored in the ROMs 64 and 66.

Both of the ROMs include the direction or address information identifying the location of the speech data within the ROM. In operation, the central processing unit 60 retrieves the necessary data and temporarily accumulates the data within its own memory. This data is stored in eight-bit bytes until 15 of such bytes are accumulated. The 120-bit package is inputted through the D0/D7 inputs of the speech integrated circuit 62 where the information is again temporarily stored and compiled. The operation of the speech synthesizer 62 is explained in detail in the accompanying copy of the referenced copending application and need not be explained in detail herein.

The various game playing keyswitches 21–27 and 31–37 as well as the game selection switches 40, 42 and 44, and the function switches 46, 48 and 50 are coupled to the microprocess chip 60 to control the operation of the microprocessor 60 and to provide inputs thereto. A piezoelectric crystal 68 and associated components including a resistor 70 and a pair of capacitors 72 and 74 provide a clock for the speech chip 62 to maintain precise operating frequency thereof. The speech wave form or voice signal from the D/A output of the chip 62 is integrated by the passive filter network comprised of resistors 122 and 124 and capacitors 126 and 128. This integrated voice signal is buffered by operational amplifier 76 which is coupled via the resistance/capacitance network including resistors 78, 82 and 84, and a capacitor 86 through switch 14 to another operational amplifier 87 which couples the voice signal to a loudspeaker 88 located under the grille 16 of FIG. 1 via a capacitor 90. The loudspeaker 88 thus provides an audible signal to the participant.

A volume control switch, generally designated 14, includes a manually movable switch element 83. The volume control switch 14 provides a volume off position, a medium volume position and a high volume position by connecting the appropriate contacts 83*a*, 83*b* and 83*c*.

A visual signal that operates at the syllabic rate of the voice signal is generated by a pair of light emitting diodes 92 and 94 located under the lens 18 of FIG. 1. The light emitting diodes 92 and 94 are driven by a transistor 96, which is in turn driven by an operational amplifier 98 and coupled thereto via a resistor 100. The amplifier 98 is coupled to the amplifier 76 via a network including a capacitor 106 and a resistor 108. Resistors 110 and 112 serve as current limiting resistors to the diodes 92 and 94, and resistors 114 and 116 form a bias voltage setting for the OP-AMP 98. The resistance/-capacitance network comprising resistors 122 and 124 (FIG. 2) and capacitors 126 and 128 form an integrating network for integrating the D/A output of the speech IC chip 62 to smooth out the voice signal generated by the speech chip 62. The capacitor 130 coupled to the $\overline{\text{RESET}}$ input of the microprocessor 60 and the resistance/capacitance network including resistor 132 and capacitor 134 coupled to the RESET input of the voice chip 62 serve to reset the aforesaid chips when power is turned on. Other capacitors associated with the 5 volt power supply serve as filter capacitors. Typical values of the various components, resistors, capacitors, etc. and identification numbers of the operational amplifiers, diodes and the like are shown in a slightly different blueprint schematic included in the Appendix A filed as a part of this application. In addition, a photograph of one embodiment of the present invention is enclosed in the Appendix to facilitate an understanding of the operation of the invention.

Figure 4:
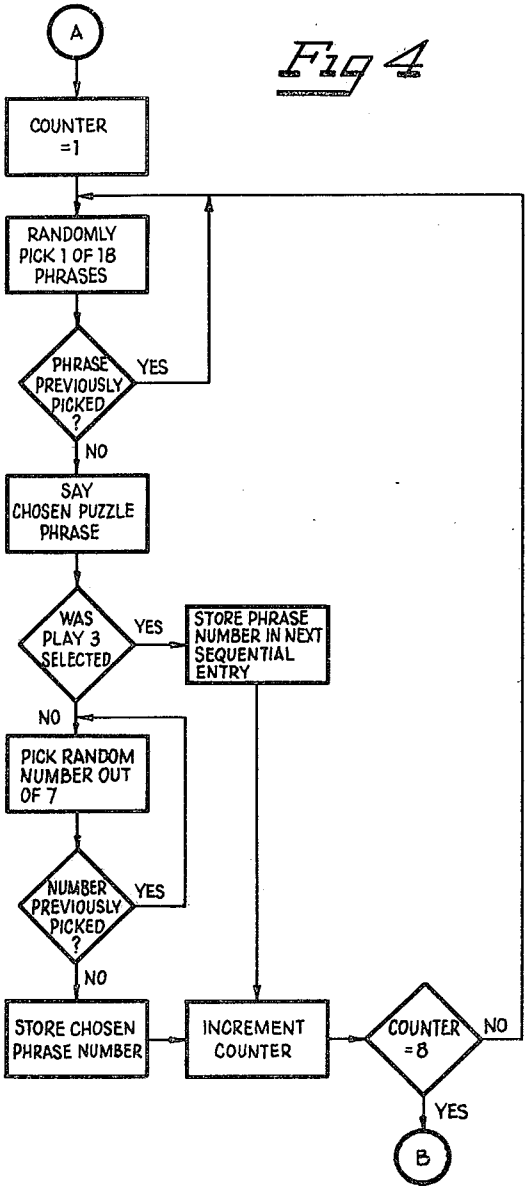
Figure 3:
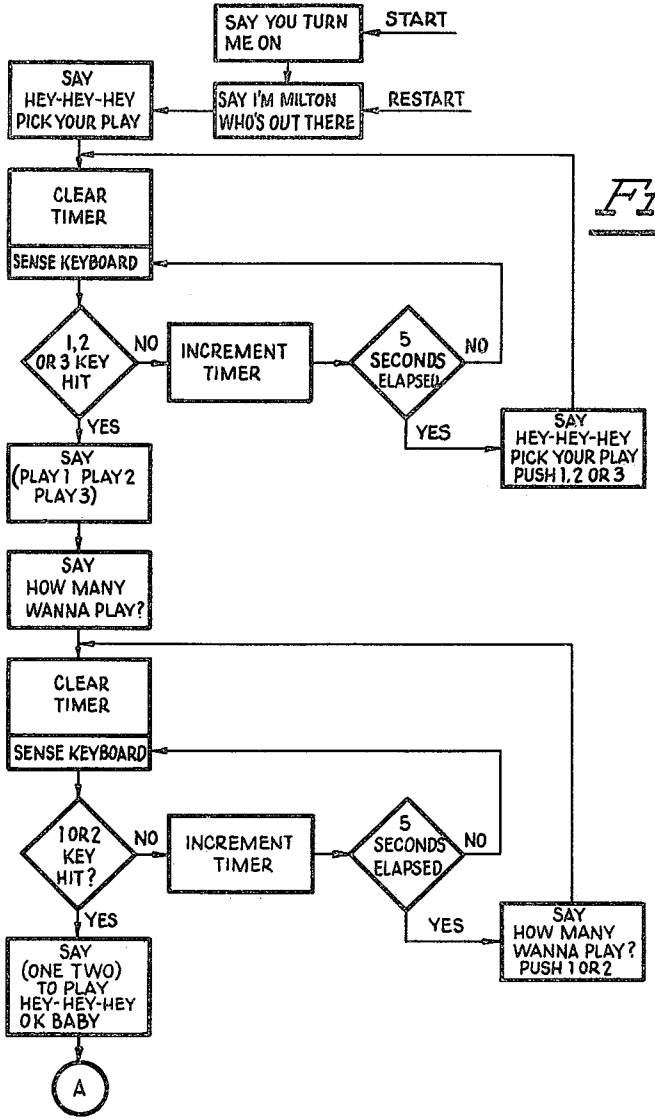
Figure 6:
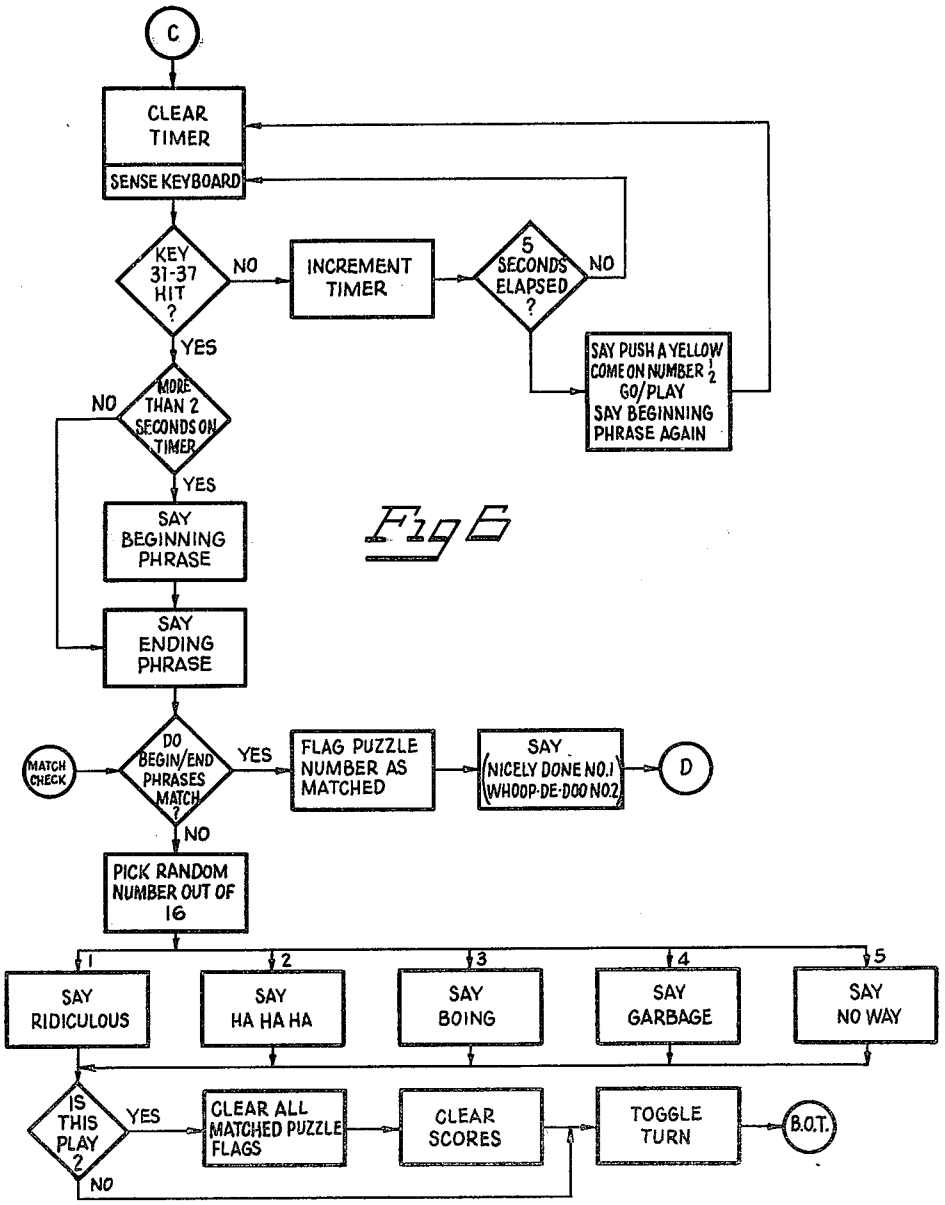

The program or game play instructions stored in the memory of the CPU60 are illustrated in flow chart form in FIGS. 3–8, with the initialization routine being illustrated in FIGS. 3 and 4. Referring now to FIG. 3, when the off/on switch is switched on, the start sequence is initiated thereby causing the device to generate a voice message such as "Hey, hey, hey, pick your play" asking the player to select one of the Games 1–3. After the voice message is generated, a timer is cleared and causes the machine to sense the keyboard. The device then waits to see whether any of the pushbuttons 40, 42 or 44 corresponding to Games 1, 2 and 3, respectively, are depressed. As long as no key is depressed, a timer is incremented, and if five seconds elapse, the previously generated voice message is repeated with the additional phrase, Push 1, 2 or 3.

After one of the push buttons 40, 42 or 44 has been depressed, the machine then states the number of the game selected by saying "Play 1", "Play 2" or "Play 3". Subsequently, the voice sequence "How many wanna play?" is generated, the timer is again cleared and the keyboard sensed again to permit the player to enter the number of players that are going to play. During the keyboard sensing interval, the timer is incremented again, and if five seconds elapse, the previous voice message is again repeated followed by the voice message "Push 1 or 2". When one of the pushbuttons 40 or 42 corresponding to one or two players is pushed, a voice message indicating the number of participants that are going to play, such as, for example, "One (or two) to play, hey, hey, hey" is generated.

In the previously described sequence of FIG. 3, the game selected and the number of players playing are established. Once this has been done, seven complete phrases including seven beginning and seven ending phrases are picked at random according to the logic sequence illustrated at FIG. 4. In the present embodiment, the seven complete phrases are chosen by first setting a counter to one and randomly picking one out of eighteen complete phrases. If one of the complete phrases chosen in this manner has been previously picked, another phrase is randomly selected, but if it had not been previously picked, a voice message enunciating the complete phrase is generated. If, during the sequence of FIG. 3, Game 3 had been selected, a pushbutton number would be assigned to each chosen phrase in sequence, that is, each of the seven complete ending phrases would be assigned a pushbutton from 31 to 37 (See FIG. 1) in the sequence in which they were chosen. If Game 3 were not selected, each complete phrase would be assigned a number ranging from one to seven picked at random. In the event that a random assignment of phrase numbers is made, a check is initiated to make sure that no two complete phrases are assigned the same number. Afterward, the phrase numbers associated with each phrase are stored, and a counter is incremented. As long as the count in the counter remains below eight, the process of randomly choosing phrases continues until the counter is set to eight, indicating that all seven complete phrases have been chosen.

After the seven complete phrases have been chosen, game play is initiated. This is accomplished by clearing the score and turn counter (FIG. 5) and determining whether Game 3 was chosen. If Game 3 were chosen, then game play would be controlled in a manner illustrated by the flow chart shown in FIG. 8 which will be discussed in a subsequent portion of the detailed description. If not, a voice signal is synthesized to prompt correct play "Push a red then a yellow" and then to indicate to the player whose turn it is to play by means of a voice message such as "Number 1 (or 2), go play". An elapsed time timer is then cleared and the device rendered operative to sense whether any one of the keys 21–27 is actuated. During the keyboard sensing time, a timer is continuously incremented until five seconds have elapsed. If no key has been hit during the five second elapsed time interval, the device generates a voice signal instructing the player how to play, for example, the machine might instruct the player to "Push a red, then a yellow - come on number 1 (or number 2), go (or play)", referring to the color of the pushbuttons 21–27 and 31–37. The elapsed time timer is then cleared, and the player is given another five seconds to respond.

If the player hits one of the keys 21–27 within the five seconds allotted, a determination is made to check whether or not that key corresponded to a complete phrase that had already been matched. If the key depressed corresponds to a complete phrase that has already been matched, a "honking horn" or "raspberry" tone is generated and the player's turn is terminated with the device then generating a voice message instructing the other player to play with a message such as "Number 2 (or 1), go (or play)". If the key depressed does not correspond to the beginning of a complete phrase that had already been matched, then the phrase number corresponding to the key depressed is stored and the beginning phrase is enunciated by the device.

After the beginning phrase is enunciated, the elapsed time timer is again cleared (FIG. 6) and the keyboard is sensed to determine whether any of the pushbuttons 31–37 are depressed within the five second period. If not, a voice message instructing the player to select one of the pushbuttons 31–37 is given, for example, "Push a yellow (relating to the color of the pushbuttons 31–37), come on Number 1 (or 2), go (or play)", and the elapsed time timer is again cleared. If one of the pushbuttons 31–37 is hit during the first five second interval or during a subsequent five second interval, the device determined the elapsed time accumulated on the timer at the time that the one of the pushbuttons 31–37 is actuated. If no more than two seconds are on the timer, the ending phrase corresponding to the actuated pushbutton is generated by the device. If more than two seconds are on the timer, the beginning phrase is again repeated followed by the ending phrase. A check between the numbers assigned to the beginning phrase and the selected ending phrase is made in order to determine whether the beginning and ending phrases match. If they do not, a number from one to sixteen corresponding to one of sixteen embarrassing messages is picked, and the embarrassing message corresponding to that number is enunciated. Typical embarrassing messages may be, for example, "Ridiculous", "Ha, ha, ha" or "No way!" or a boing sound followed by "Garbage!" A determination is then made to determine whether Game 1 or Game 2 had been selected. If Game 1 had been selected, the participating player's turn is ended, and the other player is advised to play. If Game 2 had been selected, the participating player's turn is also ended, but prior to ending the participating player's turn, all scores and flags indicating matches are cleared. If the beginning and ending phrases match, the particular completephrase is flagged as being matched, and a voice message indicating a correct response, such as "Nicely done, Number 1" or "whoop-de-doo, Number 2" is generated.

After the voice message is generated, the participant's score is incremented (FIG. 7), and a determination is made to determine whether a single player is playing or whether Game 2 is being played. If either condition is true, the score is noted in order to determine whether a score of seven has been reached. If a score of seven exists and if this is a two player game, a siren sound is issued and a voice statement such as "Number 1 just won, Nicely done, Number 1" is issued to indicate a winner. A voice signal such as "Number 1 is done", or "Number 2 is through" is issued and then the game is ended. If the score has not yet reached seven, another round of play is started. If a score of seven exists and if this is a one player game, a siren sound is issued and the voice statement "Number 1 has won—your play is . . ." is issued. The game completes the above statement with one of the following three phrases, "whoop de doo", "okay baby" or "ridiculous". As the game is being played, the device counts the number of mismatches as well as previously matched beginning phrases depressed. This number, total misses is examined. If it is seven or less, than a "whoop de doo" is issued, if eight to fifteen, then "okay baby", if any higher score, "ridiculous".

If the game selected is not Game 2 and if more than one player is playing, after the player's score is incremented, a check is made to determine whether the players score has reached four. If its has, the previously described win indicating and game ending sequence is generated. If the player's score has not yet reached four, his turn is over and the other player takes his turn.

Figure 5:
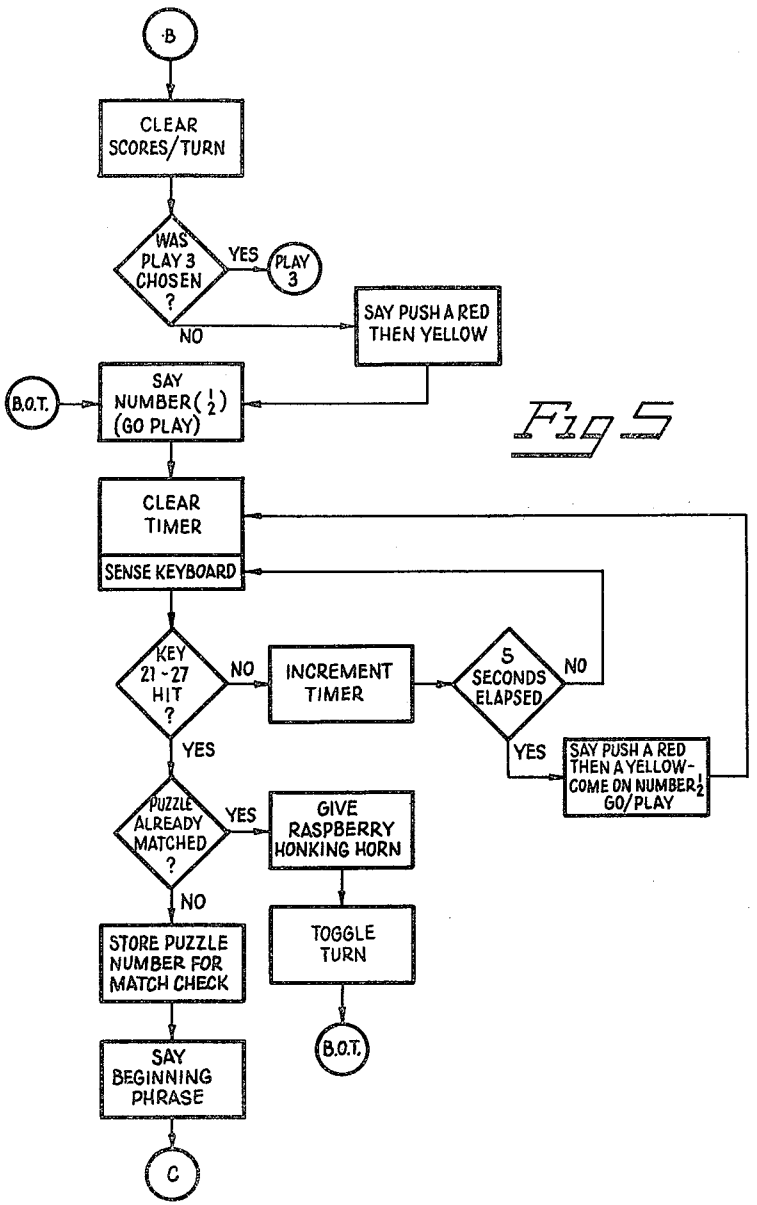

If, in the logic step illustrated in FIG. 5, it were determined that Game 3 had been selected, the control of the game would be controlled in a manner illustrated in FIG. 8. There are two modes to Game 3, and interrogation mode and a play mode. The interrogation mode precedes the play mode and exists up until the moment the go key (pushbutton 46) is depressed. During the interrogation mode an elapsed time timer is cleared, and the device senses whether any of the pushbuttons 31–37 are actuated. If one of the keys 31–37 is depressed, the corresponding ending phrase is enunciated and the timer is cleared. This permit the keyboard to be sensed again, thus permitting the player to experiment pressing various keys in an attempt to memorize the ending phrases associated with each of the keys 31–37. As soon as the go key is depressed, the device enters Game 3 play mode.

If, the go key were not depressed, the elapsed timer would be incremented. After an elapsed time of two seconds, the device would instruct the player "Come on, push go" and clear the elapsed time timer to give the player another two seconds either to actuate one of the key switches or to depress the go key. Once in play mode the device controls the play in the following manner. A random number from 1 to 7 is selected. If the phrase corresponding to this number has been matched, another random number is chosen. The beginning phrase corresponding to this number is pronounced and the player has two seconds to push the correct ending phrase. If he fails to push a key from 31–37, the device yells "TIME!" and issues the raspberry. Otherwise, the standard match check is performed and rass/reward issued according to whether a mismatch/match has been made. Play alternates between the participating players.

In addition to the above, at any time during which the keyboard is being read, the reset key 50 is enabled. Pushing of this key recycles the play to the restart label in FIG. 3, i.e., Milton says "I'm Milton - - who's out there; hee, hee, hee". This, of course, restarts the entire sequence. At the end of a game the timer is cleared and the keyboard is again scanned. Any key depressed at this time recycles play to the restart label in FIG. 3 per the restart key 50 above. At the end of a game, after five seconds with no key depressions, play is automatically recycled to the restart position.

While the above description and programming sequences, including the particular phrases described therein, have been set forth above, many modifications and variations thereof are possible in light of the above teachings of the present invention. Therefore, it is to be understood that, within the scope of the appended claims, the invention may be practiced otherwise and specifically as described above.

What is claimed and desired to be secured by Letters Patent of the United States is:

1. An electronic talking game apparatus, comprising:

means for generating a plurality of audibly perceptible beginning phrases and a plurality of audibly perceptible ending phrases, each of said ending phrases being associated with a single one of said beginning phrases;

a plurality of manually operable means, each of said manually operable means being associated with a single one of said ending phrases, said generating means being operative to generate the one of said ending phrases associated with each of said manually operable means upon the actuation thereof;

means for rendering said generating means operative to generate one of said beginning phrases; and means responsive to the generation of one of said beginning phrases and the subsequent actuation of one of said manually operable means for providing a first indication if the actuated manually operable means is associated with the ending phrase that is associated with the generated beginning phrase and for providing a second indication if the actuated manually operable means is associated with an ending phrase that is not associated with the generated beginning phrase.

2. The game apparatus of claim 1 including means responsive to said second indication for generating an audible error signal.

3. The game apparatus of claim 2 wherein said means responsive to said second indication for generating an error signal includes means for generating an audibly perceptible phrase.

4. The game apparatus of claim 1 including means responsive to said first indication for generating a win signal.

5. The game apparatus of claim 4 wherein said means responsive to said first indication for generating a win signal includes means for generating an audibly perceptible phrase.

6. The game apparatus of claim 1 or 5 wherein said plurality of manually operable means includes n switch means connected to said means for rendering said generating means operative to generate one of said phrases in response to actuation thereof.

7. A microprocessor controlled electronic talking game apparatus, comprising:

a housing;

speech synthesizing means mounted within said housing for generating a plurality of audibly perceptible beginning phrases and a plurality of audibly perceptible ending phrases, each of said ending phrases being associated with a single one of said beginning phrases;

a plurality of manually operable switch means mounted on said housing and operable by a player of the game, each one of said switch means being associated with a single one of said ending phrases;

means for rendering said speech synthesizing means operative to generate one of said beginning phrases; and means responsive to the generation of one of said beginning phrases and the actuation of one of said plurality of switch means for providing a first indication if the actuated switch means is associated with the ending phase associated with the generated beginning phrase.

8. The game apparatus of claim 7 including means for providing a second indication if the actuated switch means is associated with an ending phrase not associated with the generated beginning phrase.

9. The game apparatus of claim 7 or 8 including means responsive to said first and second indication for generating at least one audibly perceptible word subsequent to said first or second indication.

10. The game apparatus of claim 9 wherein said speech synthesizing means includes a first integrated circuit means for storing a plurality of representative sound components and second integrated circuit means, connected to said first integrated circuit means for selectively retrieving and combining said stored elements to provide an output signal capable of driving a transducer to provide said audibly perceptible phrase.

11. The game apparatus of claim 10 wherein said speech synthesizing means further includes a central processing unit connected to said first integrated circuit means and said second integrated circuit means for selectively retrieving a plurality of representative sound components from said first integrated circuit means, for temporarily storing said sound components until a predetermined number thereof have been aggregated, and outputting said predetermined number of representative sound components of said second integrated circuit means.

12. The game apparatus of claim 11 including transducing means connected to the output of said second integrated circuit means for producing a recognizable audible signal in response to the sound components received from said second integrated circuit means.

13. The game apparatus of claim 12 including a digital-to-analog converter for converting said digital sound components into an analog wave form signal for driving said transducing means.

14. The game apparatus of claim 12 including second transducing means for producing a visible signal, said second transducing means being connected to the output of said second integrated circuit for producing a visual signal in proportion to the amplitudes of said wave form signal.

15. The game apparatus of claim 14 wherein said second transducing means is a light emitting diode.

16. The game apparatus of claim 15 wherein said plurality of manually operable switch means comprises n switches connected to said rendering means for selectively generating one of said phrases.

17. The game apparatus of claim 16 wherein said first integrated circuit means comprises a large scale integrated circuit.

18. An electronic talking game apparatus, comprising:

means for indicating a set of sensorially perceptible beginning phrases and a set of sensorially perceptible ending phrases, each of said ending phrases being associated with a single one of said beginning phrases, said indicating means including means for audibly generating at least one of said sets of phrases;

a plurality of manually operable means, each of said manually operable means being associated with a single one of said ending phrases, said indicating means being operative to indicate the one of said ending phrases associated with each of said manually operable means upon the actuation thereof;

means for rendering said indicating means operative to indicate one of said beginning phrases; and means responsive to the indication of one of said beginning phrases and the subsequent actuation of one of said manually operable means for providing a first indication if the actuated manually operable means is associated with the ending phrase that is associated with the indicated beginning phrase and for providing a second indication if the actuated manually operable means is associated with an ending phrase that is not associated with the generated beginning phrase.

19. The game apparatus of claim 18 including means responsive to said second indication for generating an audible error signal.

20. The game apparatus of claim 19 wherein said means responsive to said second indication for generating an error signal includes means for generating an audibly perceptible phrase.

21. The game apparatus of claim 18 including means responsive to said first indication for generating a win signal.

22. The game apparatus of claim 21 wherein said means responsive to said first indication for generating a win signal includes means for generating an audibly perceptible phrase.

23. The game apparatus of claim 18 or 22 wherein said plurality of manually operable means includes n switch means connected to said means for rendering said indicating means operative to indicate one of said phrases in response to actuation thereof.

24. The game apparatus of claim 18 wherein said indicative means indicates said beginning phrases successively in a random order.

25. The game apparatus of claim 18 including a manually operable means associated with each of said beginning phrases, said indicating means being operative to indicate the one of said beginning phrases associated with each of said manually operable means upon the actuation thereof.

26. A microprocessor controlled electronic talking game apparatus, comprising:

a housing;

speech synthesizing means mounted within said housing for generating a plurality of audibly perceptible spoken messages, each including at least two spoken word phrases;

a plurality of manually operable switch means mounted on said housing in spaced relation and operable by a player of the game, each one of said switch means being associated with a single one of said phases; and said speech synthesizing means operative to generate the phrase associated with each of said manually operable switch means upon the actuation thereof, the switch means being arranged to conceal the association between said switch means and said phrases.

27. The game apparatus of claim 26 wherein said spoken messages each include an audibly perceptible beginning phrase and an audibly perceptible ending phrase, each of said ending phrases being associated with a single one of said beginning phases.

28. The game apparatus of claim 26 including means for rendering said synthesizing means operative to generate one of said phases.

29. The game apparatus of claim 28 including means responsive to the generation of one of said phases and the actuation of one of said switch means for providing an indication if the actuated switch means is associated with a phrase belonging to the same message as the first generated phrase.

* * * * *